US008752970B2

(12) United States Patent
Jungwirth

(10) Patent No.: US 8,752,970 B2
(45) **Date of Patent: *Jun. 17, 2014**

(54) COMPACT HIGH INTENSITY SOLAR SIMULATOR

(75) Inventor: Douglas Jungwirth, Reseda, CA (US)

(73) Assignee: The Boeing Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/533,790

(22) Filed: Jun. 26, 2012

(65) Prior Publication Data

US 2012/0262199 A1 Oct. 18, 2012

Related U.S. Application Data

(62) Division of application No. 11/685,741, filed on Mar. 13, 2007, now Pat. No. 8,220,941.

(51) Int. Cl.
*F21V 13/00* (2006.01)

(52) U.S. Cl.
USPC ..... 362/2; 362/293

(58) Field of Classification Search
USPC ..... 362/2, 293, 217.1
See application file for complete search history.

(56) References Cited

U.S. PATENT DOCUMENTS

| | | | | |
|---|---|---|---|---|
| 2,554,225 | A * | 5/1951 | Taylor | 250/252.1 |
| 3,112,886 | A * | 12/1963 | Kushner | 362/2 |
| 3,247,367 | A | 4/1966 | Rayces | |
| 3,322,946 | A * | 5/1967 | Cooper | 362/2 |
| 4,225,908 | A | 9/1980 | Small, Jr. | |
| 4,459,014 | A * | 7/1984 | Thebault | 355/32 |
| 6,548,819 | B1 | 4/2003 | Lovelady | |
| 6,590,149 | B2 * | 7/2003 | Adelhelm | 136/246 |
| 6,689,949 | B2 * | 2/2004 | Ortabasi | 136/246 |
| 7,784,977 | B2 * | 8/2010 | Moolman et al. | 362/298 |
| 8,220,941 | B2 | 7/2012 | Jungwirth | |
| 8,262,262 | B2 * | 9/2012 | Mahaffey | 362/322 |
| 2011/0026254 | A1 * | 2/2011 | Li et al. | 362/249.07 |

FOREIGN PATENT DOCUMENTS

| | | |
|---|---|---|
| EP | 0913623 | 5/1999 |
| EP | 1139016 | 4/2001 |
| FR | 2539885 | 7/1987 |
| RU | 2093859 | 10/1997 |

OTHER PUBLICATIONS

UK Search Report dated May 28, 2008 regarding application No. GB0803857.2, reference PH/P44699GB, applicant The Boeing Company, 4 pages.

USPTO Office Action dated May 28, 2010 regarding U.S. Appl. No. 11/685,741, 19 pages.

(Continued)

*Primary Examiner* — Sharon Payne
(74) *Attorney, Agent, or Firm* — Yee & Associates, P.C.

(57) ABSTRACT

A solar simulator for testing photovoltaic cells is disclosed herein. The solar simulator includes a housing having an opening through which light is emitted. The solar simulator employs a plurality of concave cylindrical mirrors and a plurality of flat mirrors that reflect and redirect images of an illuminated light source such that an observer at a target area outside the housing will perceive multiple instances of the illuminated light source. The housing also contains a flat top cover mirror and a flat bottom cover mirror that function to reflect additional light through the opening and toward the target area.

9 Claims, 10 Drawing Sheets

(56) References Cited

OTHER PUBLICATIONS

Response to Office Action dated Jul. 30, 2010 regarding U.S. Appl. No. 11/685,741, 13 pages.
Pre-Appeal Brief Conference Request dated Jan. 14, 2011 regarding U.S. Appl. No. 11/685,741, 7 pages.
USPTO Pre-Appeal Brief Conference Decision dated Mar. 9, 2011 regarding U.S. Appl. No. 11/685,741, 2 pages.
USPTO Office Action dated Jun. 3, 2011 regarding U.S. Appl. No. 11/685,741, 13 pages.
Response to Office Action dated Sep. 1, 2011 regarding U.S. Appl. No. 11/685,741, 12 pages.
USPTO Final Office Action dated Nov. 10, 2011 regarding U.S. Appl. No. 11/685,741, 18 pages.
Amendment submitted with RCE dated Feb. 10, 2012 regarding U.S. Appl. No. 11/685,741, 8 pages.
USPTO Notice of Allowance dated Mar. 14, 2012 regarding U.S. Appl. No. 11/685,741, 10 pages.

* cited by examiner

COMPACT HIGH INTENSITY SOLAR SIMULATOR

This application is a divisional application of U.S. application Ser. No. 11/685,741, entitled "COMPACT HIGH INTENSITY SOLAR SIMULATOR," filed Mar. 13, 2007, status Allowed.

TECHNICAL FIELD

Embodiments of the subject matter described herein relate generally to test equipment for photovoltaic cells. More particularly, embodiments of the subject matter relate to a solar simulator for the testing of photovoltaic cells.

BACKGROUND

Photovoltaic cells (solar cells) have been used for many years to generate electrical energy from sunlight. Solar panels, which typically include many individual cells, have been deployed in space and terrestrial applications. Terrestrial photovoltaic cells are quickly becoming a viable product and, therefore, techniques, equipment, and technologies related to the testing of terrestrial cells in a quick and economical manner are needed.

Terrestrial photovoltaic cells may be exposed to "multiple" sun sources using mirrors, reflectors, and/or lenses that concentrate sunlight into a smaller area, which results in higher radiation energy per square unit of area. Such concentration is desirable to generate higher current per cell. Accordingly, test equipment and technologies for terrestrial photovoltaic cells are often designed to test cells using light that emulates the solar energy equivalent to 500-5000 individual suns. This high level of solar energy may be necessary to accurately characterize the performance of the cells in the intended application. Moreover, such test equipment should be designed to uniformly illuminate a relatively large area that accommodates the simultaneous testing of multiple cells.

Unlike photovoltaic cells designed for outer space applications, terrestrial photovoltaic cells can be exposed to sunlight that is "filtered" through different atmospheric and/or environmental conditions. Moreover, the altitude at which the cells will be deployed can influence the spectral (wavelength) characteristics of sunlight. For example, the spectral characteristics of sunlight that reaches cells located in Sao Paolo, Brazil are different than the spectral characteristics of sunlight that reaches cells located in Phoenix, Ariz. Consequently, a solar simulator for testing photovoltaic cells should be configured to provide accurate spectral adjustability to simulate different types of sunlight conditions.

BRIEF SUMMARY

An embodiment of a solar simulator is described herein. The solar simulator employs a pulsed light source that is re-imaged multiple times to increase the illumination intensity of the output. The solar simulator includes a housing having a primary opening or mouth that is aimed toward a target area. One or more photovoltaic cells are located at the target area, and the cells are oriented to receive the light emitted from the solar simulator. The solar simulator includes concave and flat mirrors that are located within the housing. These mirrors are configured and positioned to effectively and efficiently produce the desired illumination intensity and the desired spectral characteristics for the emitted light.

The above and other aspects may be carried out in an embodiment of a solar simulator. The solar simulator includes: a housing having an opening formed therein; a light source located inside the housing; and a plurality of concave mirrors located inside the housing, the plurality of concave mirrors being positioned and configured to reflect images of the light source through the opening and toward a target area outside the housing.

The above and other aspects may be implemented in an embodiment of a solar simulator having: a housing comprising a top cover having a top cover interior side, a bottom cover having a bottom cover interior side, and an opening formed therein; a light source located inside the housing; a plurality of mirrors located inside the housing, the plurality of mirrors being positioned and configured to reflect images of the light source through the opening and toward a target area outside the housing; a first flat mirror coupled to the top cover interior side, the first flat mirror being positioned and configured to reflect images of the light source through the opening and toward the target area; and a second flat mirror coupled to the bottom cover interior side, the second flat mirror being positioned and configured to reflect images of the light source through the opening and toward the target area.

The above and other features may be carried out in an embodiment of a method of simulating solar energy. The method involves: activating an illuminated light source located inside a housing having an opening formed therein; and reflecting images of the illuminated light source with a plurality of concave mirrors located inside the housing, such that reflected images of the illuminated light source are visible through the opening from the perspective of a target area.

The above and other features may be carried out in an embodiment of a method of testing a photovoltaic cell. The method involves: locating the photovoltaic cell at a target area that is aligned with an opening of a solar simulator; activating an illuminated light source located inside a housing of the solar simulator; reflecting images of the illuminated light source with a plurality of concave mirrors located inside the housing, such that reflected light corresponding to the illuminated light source passes through the opening; radiating the photovoltaic cell with the reflected light emitted from the opening; and measuring a photovoltaic response of the photovoltaic cell.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the invention or the application and uses of such embodiments. Furthermore, there is no intention to be bound by any expressed or implied theory presented in the preceding technical field, background, brief summary or the following detailed description.

For the sake of brevity, conventional techniques related to photovoltaic cell design and testing, optics, optical filters, mirror design and manufacturing, and other functional aspects of the system (and the individual operating components of the system) may not be described in detail herein.

The following description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although the figures depict one possible arrangement of elements, additional intervening elements, devices, features, or components may be present in an embodiment of the depicted subject matter.

A solar simulator configured as described herein is designed to emit light that emulates the intensity and characteristics of multiple suns. An embodiment of the solar simulator employs a pulsed flash lamp and mirrors (flat and concave mirrors) that re-image the lamp within close proximity of the actual lamp. The solar simulator generates and directs the reflected images such that they overlap a common target area. The solar simulator also uses large, flat, parallel mirrors that are perpendicular to the axis of the lamp; these parallel mirrors reflect additional light toward the target area. A first embodiment of the solar simulator employs metal coated mirrors to shape the overall spectral content and intensity distribution. A second embodiment involves a combination of high pass, low pass, and notch filters (in addition to the metallic mirrors) to achieve the desired wavelength selectivity. A third embodiment of the solar simulator employs wavelength-selective reflectivity coatings on the mirrors to shape the overall spectral content of the illuminating light. A fourth embodiment of the solar simulator employs absorbing "neutral density" filters that are inserted in one or more individual imaging paths to adjust the overall spectral content of the illuminating light. The solar simulator is designed to be symmetric about its central illuminating axis, which allows for balancing of the intensity distribution (for each wavelength band) across the target area.

Figure 1:
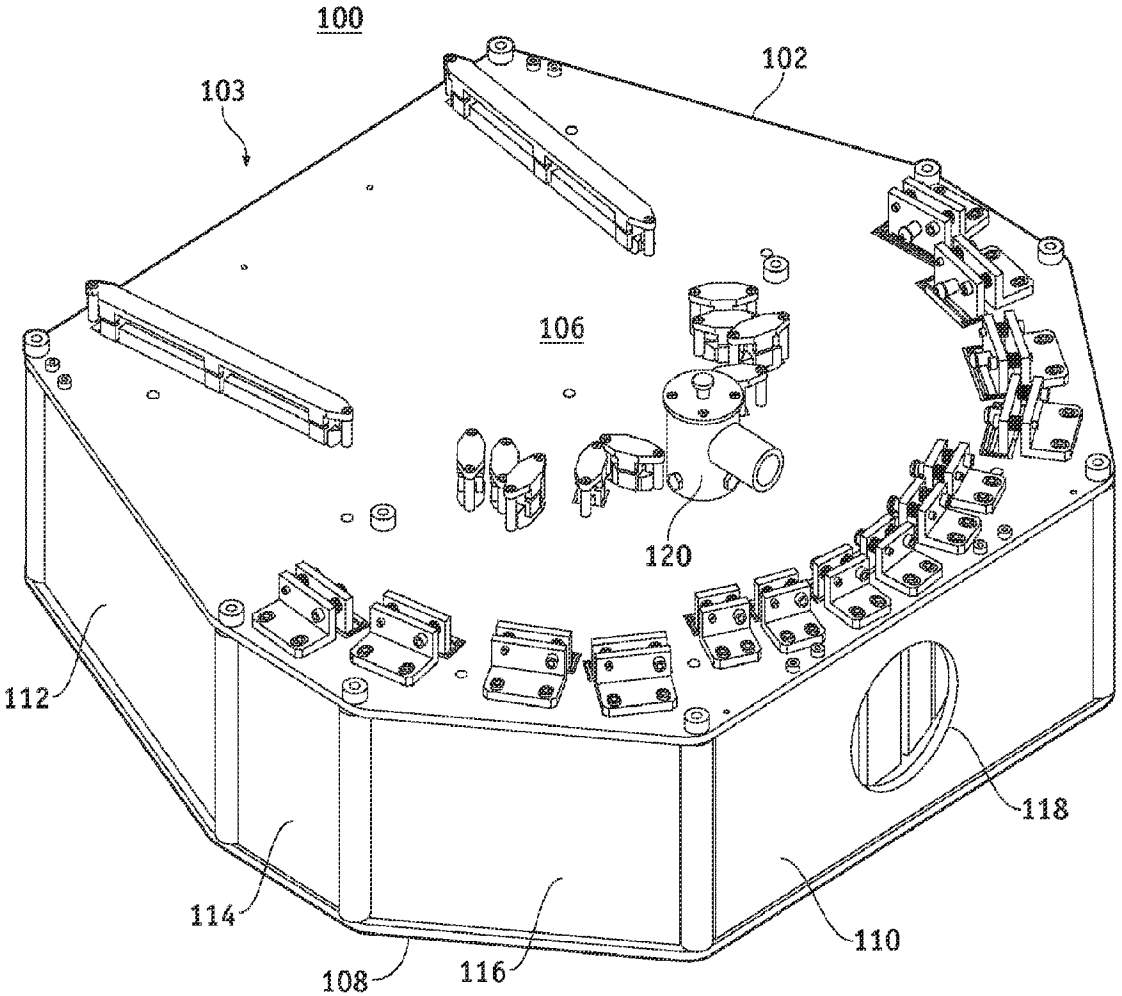
FIG. 1 is an isometric view of an embodiment of a solar simulator.
Figure 2:
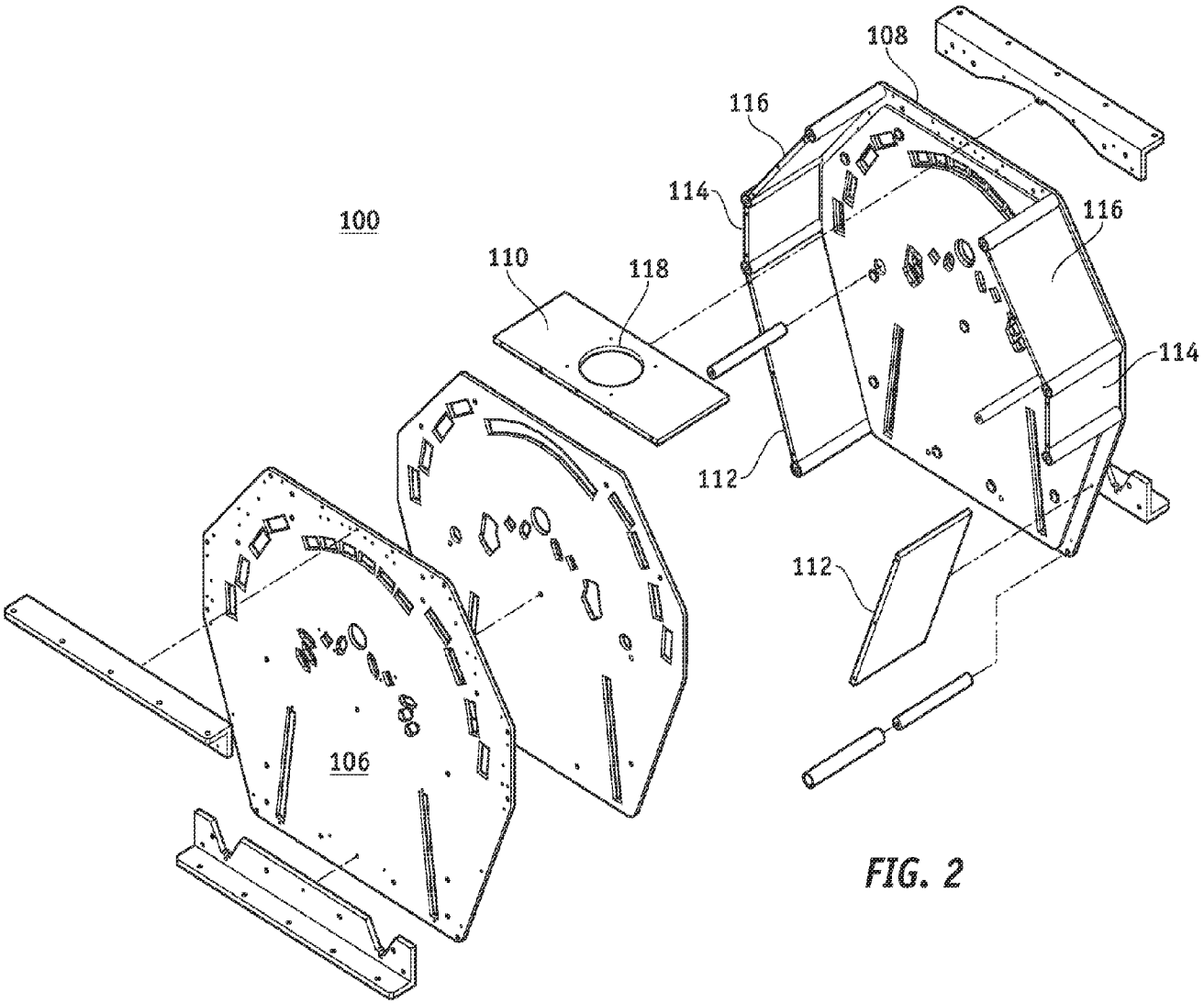
FIG. 2 is an exploded isometric view of various components of the solar simulator.
Figure 3:
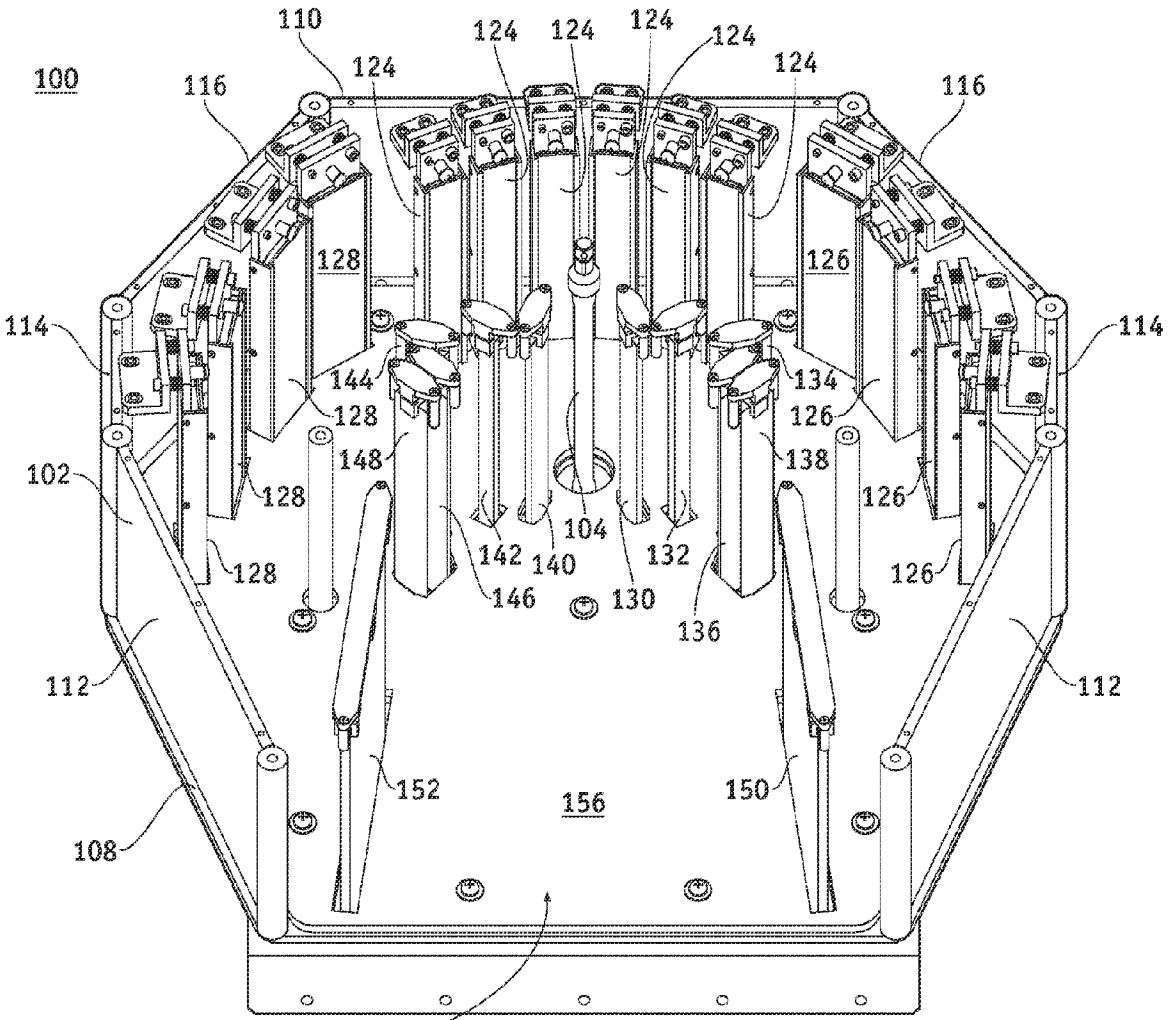
FIG. 3 is an isometric top view of the solar simulator with its top cover removed.
Figure 4:
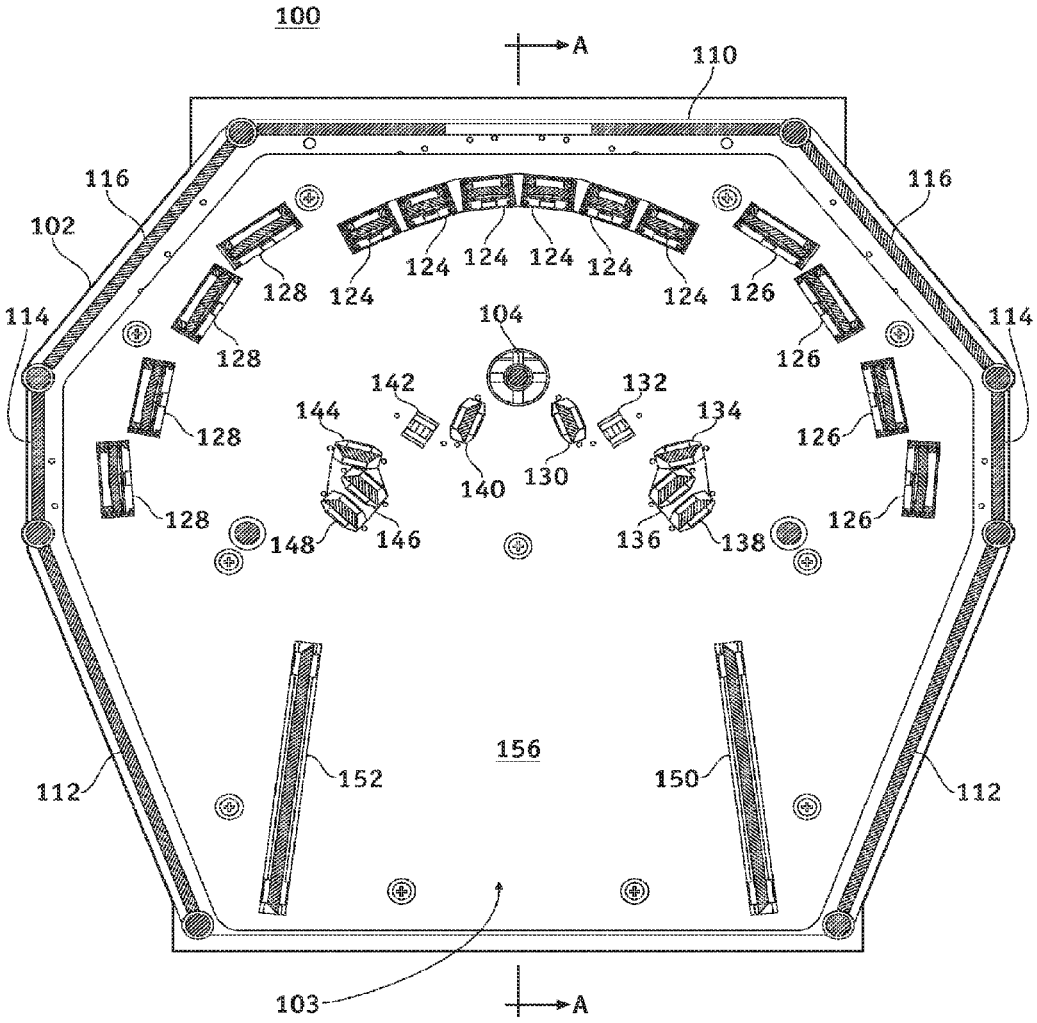
FIG. 4 is a top view of the solar simulator with its top cover removed.
Figure 5:
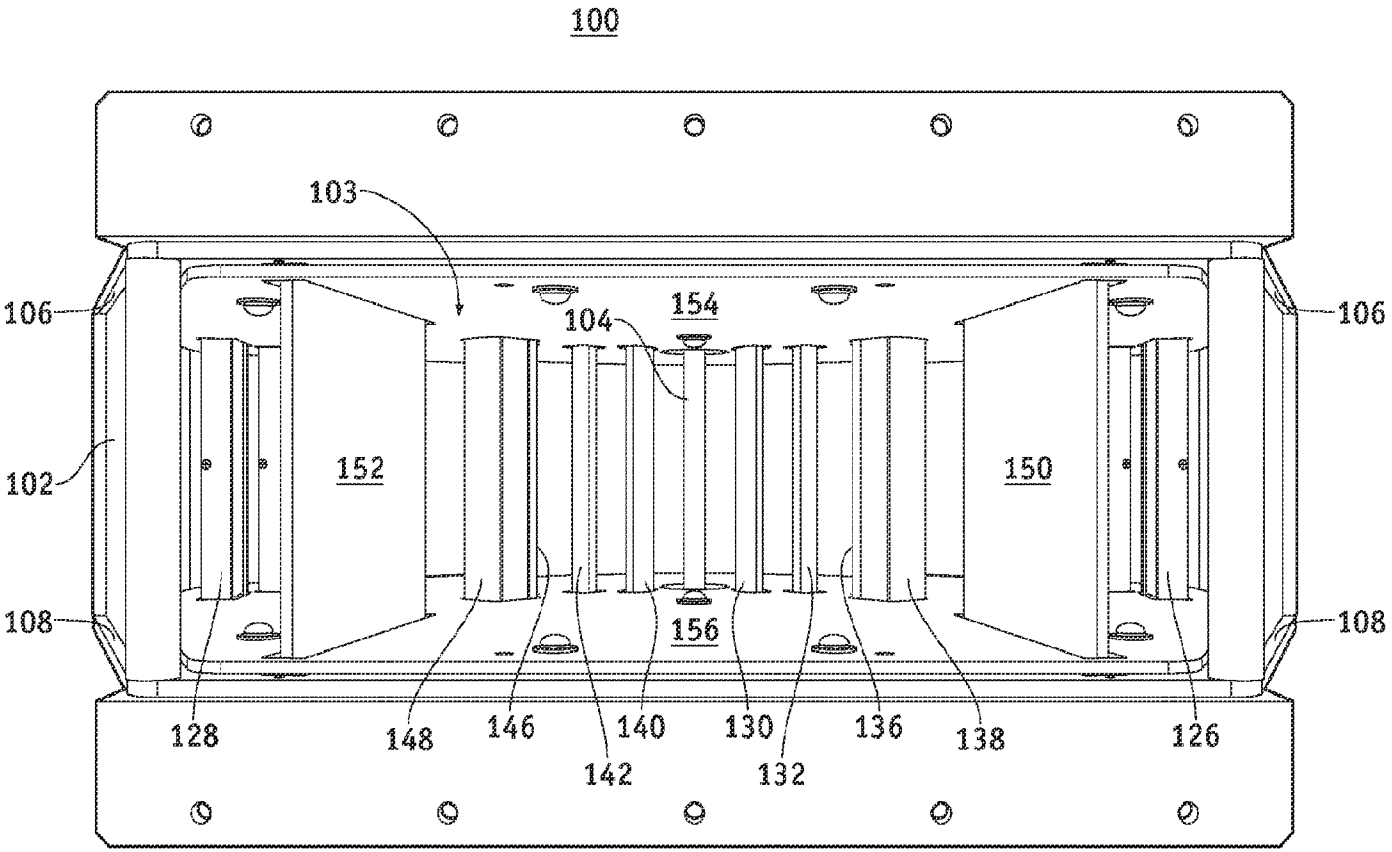
FIG. 5 is an isometric front view of the solar simulator as viewed from its main opening.
Figure 6:
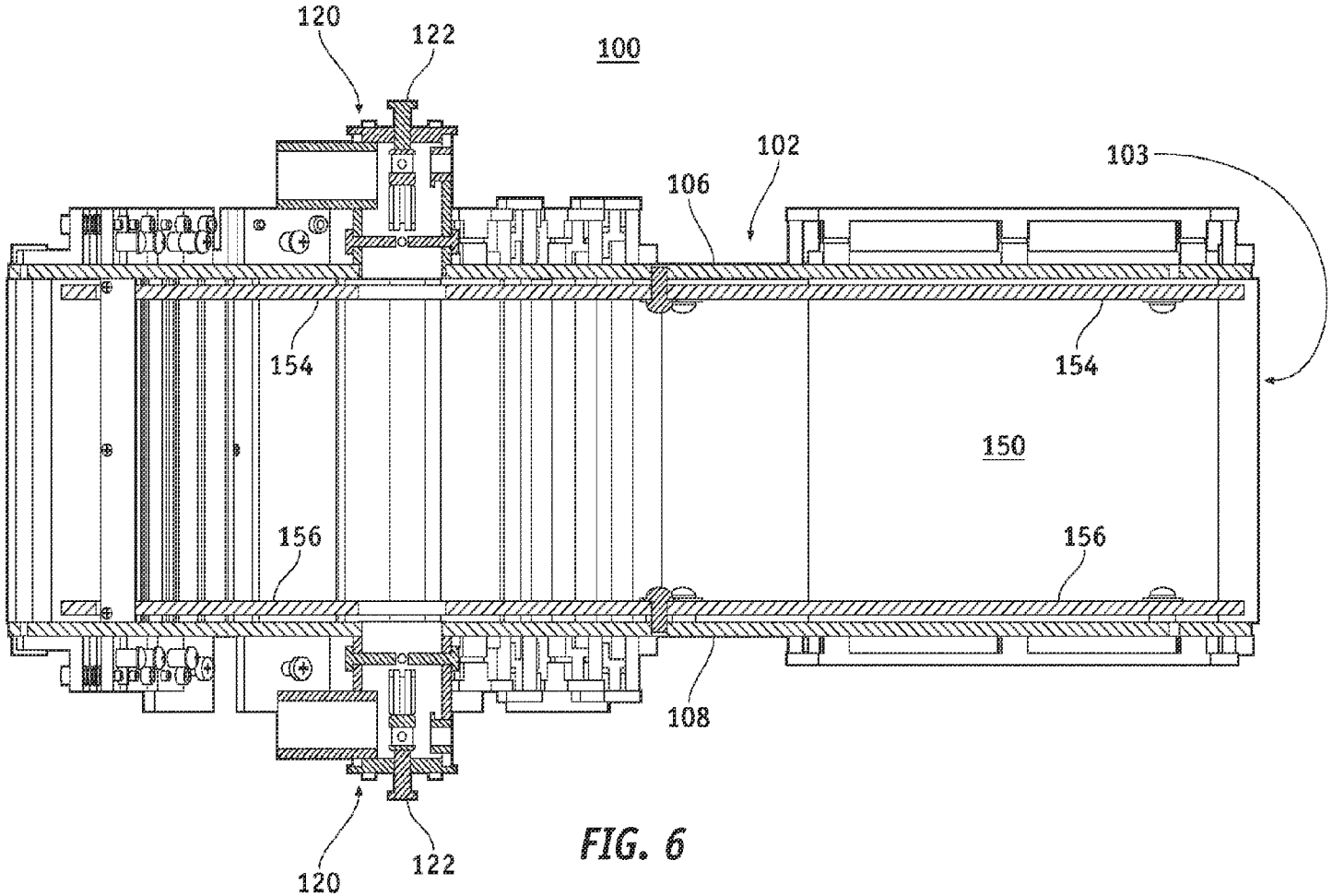
FIG. 6 is a cross sectional view of the solar simulator as viewed from line A-A in FIG. 4.

The figures depict an embodiment of a solar simulator. FIG. 1 is an isometric view of an embodiment of a solar simulator 100, FIG. 2 is an exploded isometric view of various components of solar simulator 100, FIG. 3 is an isometric top view of solar simulator 100 with its top cover removed, FIG. 4 is a top view of solar simulator 100 with its top cover removed, FIG. 5 is an isometric front view of solar simulator 100 as viewed from its main opening, and FIG. 6 is a cross sectional view of solar simulator 100 as viewed from line A-A in FIG. 4. Solar simulator 100 is described below with concurrent reference to FIGS. 1-7.

Solar simulator 100 generally includes a housing 102 having a primary opening 103 formed therein, a light source 104 located inside housing 102, and a plurality of mirrors located inside housing 102. The mirrors are suitably configured and positioned within housing 102 to reflect images of light source 104 through primary opening 103 and toward a target area located outside housing 102. The target area represents the intended testing location for photovoltaic cells, which are illuminated by solar simulator 100.

Housing 102 functions as a protective enclosure for light source 104 and the internal mirrors. Housing 102 also functions to direct reflected light beams out of primary opening 103 and to prevent light from escaping elsewhere. This enhances the safety and illumination efficiency of solar simulator 100. The illustrated embodiment of housing 102 includes a top cover 106, a bottom cover 108, a rear wall 110, two primary sidewalls 112, two minor sidewalls 114, and two angled rear walls 116. These pieces can be coupled together using screws, bolts, rivets, or any suitable fastener, attachment mechanism, or attachment technique. In practice, the pieces of housing 102 can be formed from any suitable material such as aluminum, steel, fiberglass, or the like. For the illustrated embodiment, housing 102 is about five inches high (the dimension between top cover 106 and bottom cover 108), about twenty inches wide (the dimension between minor sidewalls 114), and about nineteen inches deep (the dimension between primary opening 103 and rear wall 110). Of course, the specific dimensions of an embodiment of solar simulator 100 can be adjusted to suit the needs of the particular application, testing procedure, desired light characteristics, etc.

Although not required in all embodiments, rear wall 110, primary sidewalls 112, minor sidewalls 114, and angled rear walls 116 are generally rectangular in shape, and they are all of the same height. This common height is desirable to maintain top cover 106 and bottom cover 108 in a parallel orientation. Referring to FIG. 4, rear wall 110 is parallel to the plane defined by primary opening 103, and minor sidewalls 114 are parallel to each other. Notably, each angled rear wall 116 forms an obtuse angle with rear wall 110. In certain embodiments, the angle formed between rear wall 110 and each angled rear wall 116 is within the range of about 130 degrees. Moreover, each primary sidewall 112 forms an obtuse angle with its respective minor sidewall 114. In certain embodiments, the angle formed between a primary sidewall 112 and its respective minor sidewall 114 is within the range of about 160 degrees.

As shown in FIG. 1 and FIG. 2, rear wall 110 may include an opening 118 formed therein. In this embodiment, opening 118 is circular, and it is centrally located in rear wall 110. Opening 118 is utilized to accommodate the installation of one or more cooling fans as needed.

Light source 104 is suitably configured to generate bright white light when commanded. In practice, light source 104 is a pulsed continuous wave source that emits a bright flash to test photovoltaic cells at the target area. For the testing of most solar cells, light source 104 generates light having a wide range of wavelengths that approximates the wavelengths of sunlight. Use of a pulsed light source 104 is desirable to maintain relatively low temperatures inside housing 102. The intensity of light source 104 and the number and configuration of mirrors inside housing 102 enables solar simulator 100 to generate light having an intensity that emulates multiple suns, e.g., up to 5000 suns. In one practical embodiment, light source 104 is realized with a pulsed, high pressure xenon flash lamp (of course, other suitable lamps or subsystems can be utilized for light source 104).

Referring to FIG. 3 and FIG. 5, the lamp utilized for light source 104 may be tube or cylindrical shaped, and it may be positioned such that its longitudinal axis is perpendicular to top cover 106 and bottom cover 108. Accordingly, in this embodiment, most of the light emitted by light source 104 is perpendicular relative to the longitudinal axis of the lamp, or parallel to the planes defined by top cover 106 and bottom cover 108. This orientation of the emitted light is desirable to increase the efficiency and effectiveness of the mirrors contained in housing 102.

Referring to FIG. 1 and FIG. 6, solar simulator 100 may include a suitably configured fixture 120 for holding and activating light source 104. Fixture 120 may include one or more components coupled to top cover 106 and one or more components coupled to bottom cover 108. The components of fixture 120 can be manipulated to align and adjust light source 104 from housing 102 as needed. In addition, fixture 120 may include electrical contacts or connectors 122 for receiving electrical control/activation signals for light source 104. Fixture 120 is also used to adjust the position of the lamp in the housing. In practice, the actual electrical connections are provided through the horizontal tubes (which are perpendicular to the axis of light source 104) located near connectors 122. The electrical contacts with the electrodes of light source 104 can be established using clamps or any suitable electrical connection feature. In practice, solar simulator 100 is controlled by an appropriate power system, switching arrangement, or control mechanism that controls the activation of light source 104.

FIGS. 3-5 illustrate one suitable arrangement of mirrors inside housing 102. This embodiment utilizes a combination of concave cylindrical mirrors, flat mirrors, and flat surface mirrors to reflect images of light source 104 back toward the target area. For example, solar simulator 100 includes six rear concave cylindrical mirror assemblies 124, eight side concave cylindrical mirror assemblies 126/128, ten flat mirror assemblies (reference numbers 130, 132, 134, 136, 138, 140, 142, 144, 146, and 148), two flat exit mirror assemblies 150/152, a flat top mirror assembly 154, and a flat bottom mirror assembly 156. FIG. 3 and FIG. 4 depict the vertically oriented mirror assemblies with their respective mounting brackets installed (see FIG. 1, which shows the mounting brackets coupled to top cover 106). Each of the vertically oriented concave cylindrical mirror assemblies and each of the vertically oriented flat mirror assemblies has a longitudinal axis that is parallel to the longitudinal axis of light source 104. The mirrors of solar simulator 100 are sized, shaped, arranged, and positioned to reflect images of light source 104 through primary opening 103 and toward the target area in a concentrated manner.

This particular embodiment of solar simulator 100 has "reflective" or "optical" symmetry about an axis that is defined by a line that extends between light source 104 and a center of the target area. In other words, solar simulator 100 has a left-right axis of symmetry as viewed from the top or bottom. In this regard, the cross sectional line A-A in FIG. 4 represents this axis of symmetry. Notably, rear concave mirror assemblies 124 and the mirrors associated therewith represent sets of mirrors that are symmetrical about this axis—three on each side of the axis. Likewise, side concave mirror assemblies 126 and the mirrors associated therewith are symmetrical with side concave mirror assemblies 128 and the mirrors associated therewith. In other words, each side concave mirror assembly 126 has a corresponding side concave mirror assembly 128, where the two form a set that is symmetrical about the axis. Likewise, flat mirror assemblies 130 and 140 form a first symmetrical set, flat mirror assemblies 132 and 142 form a second symmetrical set, flat mirror assemblies 134 and 144 form a third symmetrical set, flat mirror assemblies 136 and 146 form a fourth symmetrical set, flat mirror assemblies 138 and 148 form a fifth symmetrical set, and flat exit mirror assemblies 150 and 152 form a sixth symmetrical set. This reflective and optical symmetry facilitates effective balancing of the intensity distribution for the various wavelength bands across the target area.

Figure 7:
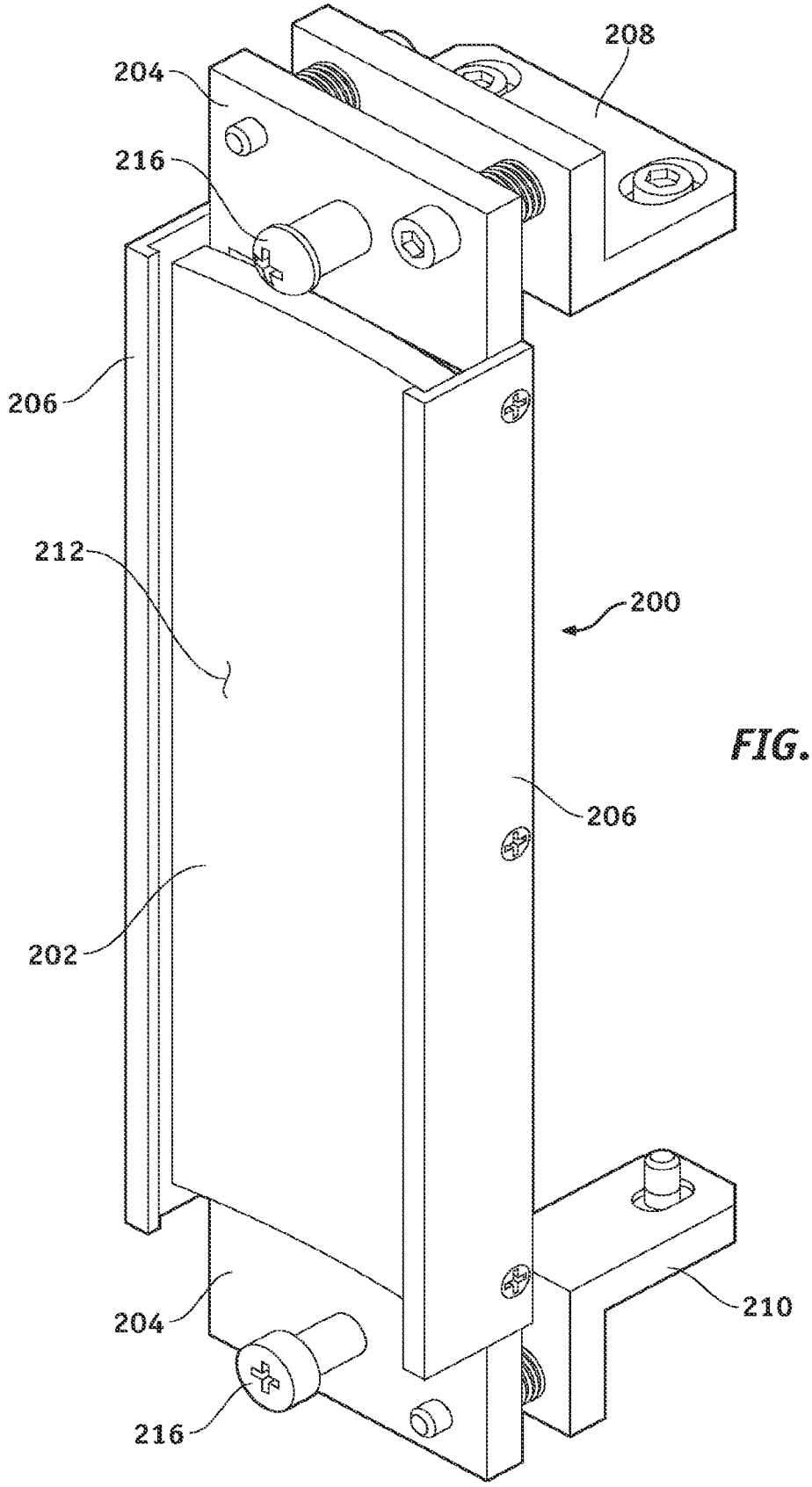
FIG. 7 is an isometric view of an embodiment of a mirror assembly suitable for use in the solar simulator.
Figure 8:
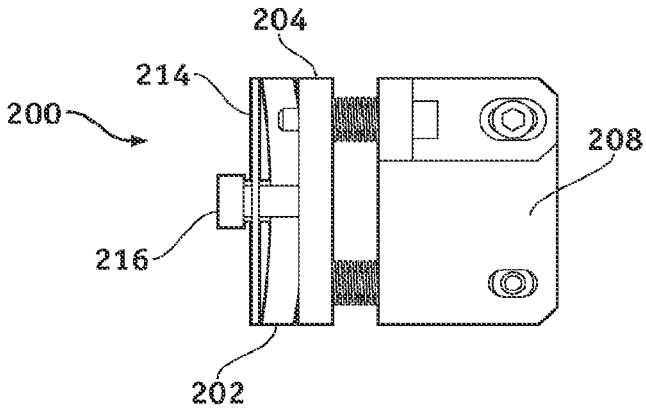
FIG. 8 is a top view of the mirror assembly.
Figure 9:
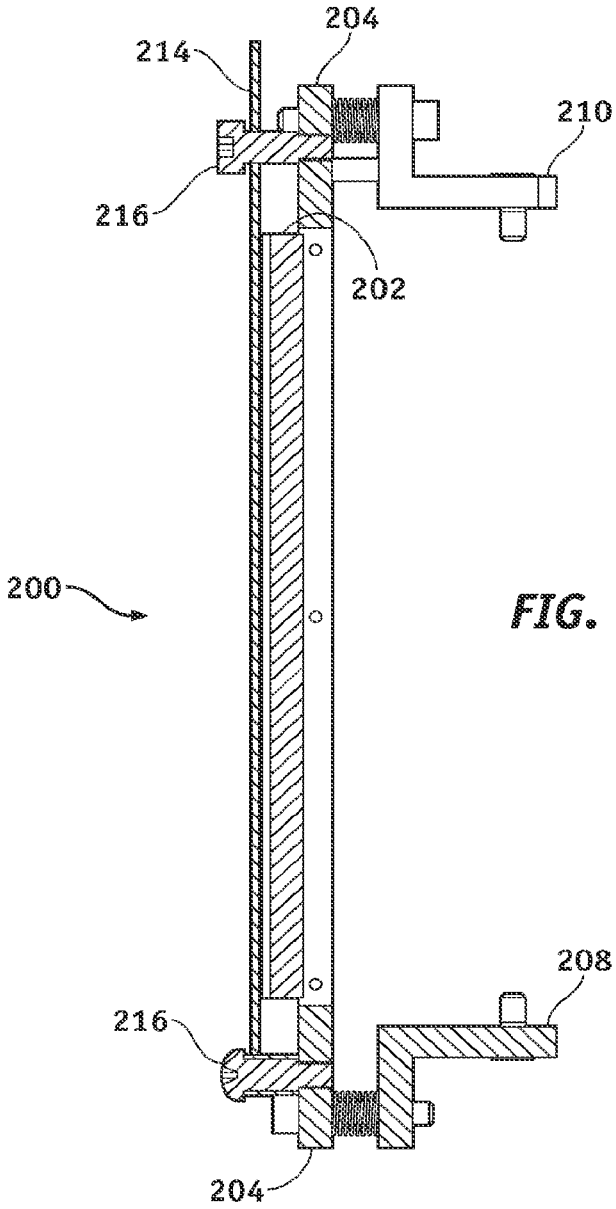
FIG. 9 is a side sectional view of the mirror assembly.

FIG. 7 is an isometric view of an embodiment of a mirror assembly 200 suitable for use in solar simulator 100, FIG. 8 is a top view of mirror assembly 200, and FIG. 9 is a side sectional view of mirror assembly 200. An appropriately sized and shaped mirror assembly 200 can be utilized for each rear concave mirror assembly 124 and each side concave mirror assembly 126/128. Mirror assembly 200 generally includes, without limitation: a concave cylindrical mirror 202; a mounting plate 204 coupled to concave cylindrical mirror 202; and side rails 206 (not shown in FIG. 8) coupled to mounting plate 204. FIGS. 7-9 also depict an upper mounting bracket 208, a lower mounting bracket 210, and associated fasteners that can be utilized to secure mirror assembly 200 to the housing of the solar simulator. For example, upper mounting bracket 208 may be coupled to the top cover of the solar simulator (see FIG. 1), and lower mounting bracket 210 may be coupled to the bottom cover of the solar simulator.

The exposed reflective surface 212 of concave cylindrical mirror 202 is concave. In certain embodiments, concave cylindrical mirror 202 includes a reflective surface 212 that is shaped as a cylindrical section. This contour is apparent in the top view of FIG. 8. This cylindrical contour is desirable because it is easy to manufacture, it has predictable reflective characteristics, and it enables images of the light source to be efficiently concentrated. Referring again to FIGS. 3-5, the radius of the concave mirrors utilized for rear concave mirror assemblies 124 is within the range of about four inches, while the radius of the concave mirrors utilized for side concave mirror assemblies 126/128 is within the range of about six inches. In the illustrated embodiment, the radius of the concave cylindrical mirrors used for rear concave mirror assemblies 124 is less than the radius of the concave mirrors used for side concave mirror assemblies 126/128.

Mounting plate 204 may be realized as a flat support structure having a length of about 6.5 inches, a width of about 1.5 inches, and a thickness of about 0.2 inches. Referring to FIGS. 7-9, concave mirror 202 is coupled to mounting plate 204 using an appropriate adhesive, bonding material, or the like. Alternatively, concave mirror 202 can be coupled to mounting plate 204 using side rails 206, a press fitting arrangement, or the like. In certain embodiments, reflective surface 212 of concave mirror 202 is not interrupted by fasteners or mounting mechanisms. Concave mirror 202 does not span the entire length of mounting plate 204—this allows the ends of mounting plate 204 to extend above and below the housing of the solar simulator (see FIG. 1). The ends of mounting plate 204 extend above and below the housing of the solar simulator such that they can be secured to upper mounting bracket 208 and lower mounting bracket 210. In the illustrated embodiment, the ends of mounting plate 204 are coupled to upper mounting bracket 208 and lower mounting bracket 210 using spring-loaded fasteners. This mounting technique enables mirror assembly 200 to be quickly aligned, removed, and replaced as needed.

Mirror assembly 200 may be configured to receive a filter 214, as shown in FIG. 8 and FIG. 9. Filter 214 can be realized as a removable element that can be positioned in front of concave mirror 202. Accordingly, filter 214 may be secured using screws or bolts 216, and filter 214 may be supported by side rails 206. Filter 214, which is positioned in the imaging path between concave mirror 202 and the target area, is suitably configured to alter the spectral content of light passing through it. In certain embodiments of a solar simulator, a plurality of such filters 214 can be utilized for a plurality of individual mirror assemblies 200. In such embodiments, the plurality of filters 214 can be cooperatively selected to individually filter the light as desired and to tune an overall spectral content of light reaching the target area. In practice, these filters 214 will be located inside the housing of the solar simulator such that the light emitted from the solar simulator will have the desired spectral characteristics. The use of individual filters 214 facilitates fine tuning of the wavelengths of light generated by the solar simulator. It should be appreciated that filters 214, individually or in combination, are exemplary means for selectively filtering reflected images corresponding to mirrors in the solar simulator.

In lieu of (or in addition to) filter 214, concave mirror 202 itself may be realized as a wavelength-sensitive reflector that only reflects certain wavelengths of light. In contrast, filter 214 blocks unwanted wavelengths and passes the desired wavelengths. As described above, the solar simulator may employ a plurality of mirrors having wavelength-sensitive characteristics that are cooperatively selected to tune the overall spectral content of light reaching the target area. In practical embodiments, the wavelength-sensitivity of concave mirror 202 can be achieved using wavelength-sensitive coatings on reflective surface 212 of concave mirror 202. The use of different coatings for the individual mirrors facilitates fine tuning of the wavelengths of light generated by the solar simulator. In this regard, such wavelength-sensitive coatings, individually or in combination, are exemplary means for selectively filtering images corresponding to mirrors in the solar simulator.

As mentioned above, the mirrors of solar simulator are symmetrically arranged about the left-right axis of symmetry. In embodiments that utilize filters or reflective coatings to adjust the spectral content of the emitted light, the filters/coatings are preferably deployed in a symmetrical manner such that light associated with sets of symmetrical mirrors has matching spectral characteristics. For example, the two outermost rear concave mirror assemblies 124 may include red filters, while the two innermost rear concave mirror assemblies 124 may include blue filters. As another example, flat mirror assemblies 130 and 140 may remain unfiltered and uncoated, flat mirror assemblies 132 and 142 may employ reflective coatings that reflect relatively high wavelengths, and flat mirror assemblies 136 and 146 may employ reflective coatings that reflect relatively low wavelengths.

Flat mirror assemblies 130, 132, 134, 136, 138, 140, 142, 144, 146, and 148 are also suitably configured and positioned to reflect images of light source 104 through primary opening 103 and toward the target area. The width of the mirrors used in these flat mirror assemblies may be in the range of 0.500 to 0.875 inches. These flat mirror assemblies may be generally configured as described above for mirror assembly 200. As shown in FIG. 1 and FIG. 3, these flat mirror assemblies may utilize different types of mounting brackets for housing 102 (otherwise, the installation, alignment, removal, and securing technique is similar to that described above).

For the illustrated embodiment, each rear concave mirror assembly 124 and each side concave mirror assembly 126/128 is positioned such that it directly reflects an image of light source 104 and produces a reflected image of light source 104. In contrast, at least some of the flat mirror assemblies are suitably configured and positioned to indirectly reflect images of light source. In other words, a flat mirror assembly may be positioned to further reflect a reflected image of light source 104 through primary opening 103. Such re-imaging and redirection may be desirable to ensure that the target area is effectively and efficiently illuminated. The specific reflective characteristics of these mirror assemblies is described in more detail below.

Each flat exit mirror 150/152 is positioned such that it directly reflects an image of light source 104 and produces a reflected image of light source 104. Flat exit mirrors 150/152 also serve to redirect additional light toward the target area. Flat exit mirrors 150/152 may be generally configured as described above for mirror assembly 200. As shown in FIG. 1 and FIG. 3, these flat exit mirror assemblies 150/152 may utilize different types of mounting brackets for housing 102 (otherwise, the installation, alignment, removal, and securing technique is similar to that described above). In practice, the mirrors used in flat exit mirror assemblies 150/152 may have a height within the range of about 5.0 to 7.0 inches and a width within the range of about 4.5 to 6.5 inches.

Referring to FIGS. 2-6, top cover 106 of housing 102 has an interior side that faces light source 104, and bottom cover 108 of housing 102 has an interior side that faces light source 104. For this embodiment, flat top mirror assembly 154 is coupled to the interior side of top cover 106, while flat bottom mirror assembly 156 is coupled to the interior side of bottom cover 108. Flat top mirror assembly 154 includes a flat mirror having a reflective surface exposed to light source 104. Likewise, flat bottom mirror assembly 156 includes a flat mirror having a reflective surface exposed to light source 104. Notably, the other mirrors in housing 102 extend between flat bottom mirror assembly 156 and flat top mirror assembly 154. These two flat mirrors are suitably configured and positioned to reflect images of light source 104 through primary opening 103 and toward the target area. These two flat mirrors also serve to direct additional "scattered" or "ambient" light (having certain incident angles relative to their respective reflective surfaces) through primary opening 103 to increase the illumination intensity. Thus, an observer looking into primary opening 103 will perceive reflections of light source 104 extending above and below the reflective planes of flat top mirror assembly 154 and flat bottom mirror assembly 156. Moreover, an observer looking into primary opening 103 will perceive reflections of the other concave and flat mirror assemblies extending above and below the reflective planes of flat top mirror assembly 154 and flat bottom mirror assembly 156.

Figure 10:
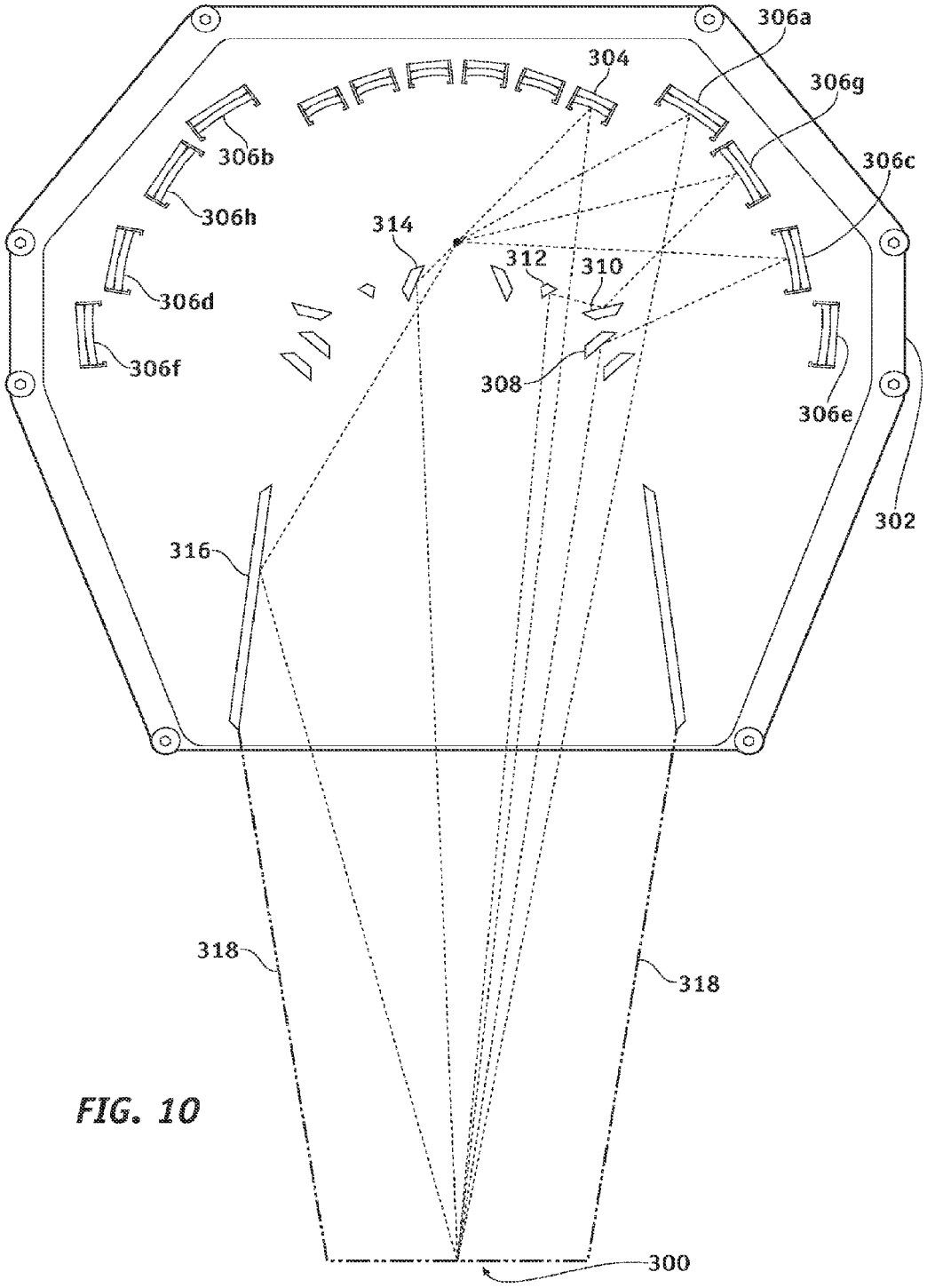
FIG. 10 is a diagram that illustrates reflected paths for a target area as generated by an embodiment of a solar simulator.

FIG. 10 is a diagram that illustrates reflected paths for a target area 300 as generated by an embodiment of a solar simulator 302 having a mirror arrangement as described above. This diagram depicts typical testing conditions where target area 300 is approximately five inches high and approximately five inches wide, and where the distance from the light source inside solar simulator 302 to target area 300 is about 25 inches. For the sake of simplicity and clarity, only some of the possible reflection paths are depicted in FIG. 10.

As mentioned above, solar simulator 302 includes six rear concave mirror assemblies 304. Each rear concave mirror assembly 304 is configured, positioned, and arranged such that it primarily reflects the light source in a direct path toward target area 300. In this regard, the longitudinal centerline of each concave mirror assembly 304 is preferably aligned with the longitudinal centerline of the light source, and with the center of target area 300. For example, FIG. 10 depicts this direct reflection path for the uppermost rear concave mirror assembly 304.

Solar simulator 302 also includes eight side concave mirror assemblies 306. In this embodiment, two of these side concave mirror assemblies (306*a* and 306*b*) are configured, positioned, and arranged to primarily reflect the light source in a direct path toward target area 300. Thus, the longitudinal centerlines of these two side concave mirror assemblies 306*a*/306*b* are preferably aligned with the longitudinal centerline of the light source, and with the center of target area 300. For example, FIG. 10 depicts this direct reflection path for side concave mirror assembly 306*a*. A similar path is associated with the symmetrical side concave mirror assembly 306*b*. In addition, four of the side concave mirror assemblies (306*c*, 306*d*, 306*e*, and 306*f*) are suitably configured, positioned, and arranged to primarily reflect the light source toward a flat mirror, which in turn redirects the reflected image toward target area 300. In this regard, the longitudinal centerline of each side concave mirror assembly 306*c*/306*d*/306*e*/306*f* is preferably aligned with the longitudinal centerline of the light source, and with the longitudinal centerline of a respective flat mirror assembly, which is aligned with the center of target area 300. For example, FIG. 10 depicts this indirect reflection path for side concave mirror assembly 306*c*, which cooperates with a flat mirror assembly 308. Similar paths are associated with side concave mirror assemblies 306*d*, 306*e*, and 306*f*.

Moreover, two of the side concave mirror assemblies 306*g*/306*h* are suitably configured, positioned, and arranged to primarily reflect the light source toward a flat mirror, which in turn redirects the reflected image toward another flat mirror, which in turn redirects the re-reflected image toward target area 300. In this regard, the longitudinal centerline of each side concave mirror assembly 306*g*/306*h* is preferably aligned with the longitudinal centerline of the light source, and with the longitudinal centerline of a respective first flat mirror assembly, which in turn is aligned with the longitudinal centerline of a respective second flat mirror assembly, which in turn is aligned with the center of target area 300. For example, FIG. 10 depicts this indirect reflection path for side concave mirror assembly 306*g*, which cooperates with a flat mirror assembly 310 and a flat mirror assembly 312. A similar path is associated with the symmetrical side concave mirror assembly 306*h*.

Solar simulator 302 preferably includes one or more flat mirror assemblies that are suitably configured, arranged, and positioned to primarily reflect the light source directly toward target area 300. For example, a flat mirror assembly 314 is positioned to directly reflect the light source toward target area 300. In this regard, the longitudinal centerline of flat mirror assembly 314 is preferably aligned with the longitudinal centerline of the light source, and with the center of target area 300. For example, FIG. 10 shows the direct reflection path for flat mirror assembly 314. A similar path is associated with the symmetrical flat mirror assembly that forms a set with flat mirror assembly 314.

In addition, a flat exit mirror assembly 316 is positioned to directly reflect the light source toward target area 300. In this embodiment, the mirror of flat exit mirror assembly 316 forms an acute angle relative to the line corresponding to the direct path between the light source and the center of target area 300. This acute angle is within the range of about 17 to 21 degrees. For example, FIG. 10 also shows the direct reflection path for flat exit mirror assembly 316. A similar path is associated with the symmetrical flat exit mirror assembly that forms a set with flat exit mirror assembly 316. The outer observation "boundary" 318 of solar simulator 302 is approximately defined by the reflection range of the two flat exit mirrors, as depicted in FIG. 10. Of course, the light source also emits light that follows a direct path to target area 300, i.e., the light is emitted directly out of the primary opening of solar simulator 302 without being reflected.

In practice, solar simulator 302 produces 19 separate images of the light source: the original light source; 14 reflections corresponding to the 14 concave mirror assemblies; and four reflections corresponding to the four flat exit mirror assemblies. Consequently, the intensity at the target area is at least 19 times the intensity of the light source itself. Additionally, the light reflected up and down from flat top mirror assembly 154 and flat bottom mirror assembly 156 appear as inverted, truncated lamp images from each of the original lamp images. Thus, the reflected images of the light source may be 25% to 75% longer than the actual light source itself, as viewed from the vantage point of the target area.

Figure 11:
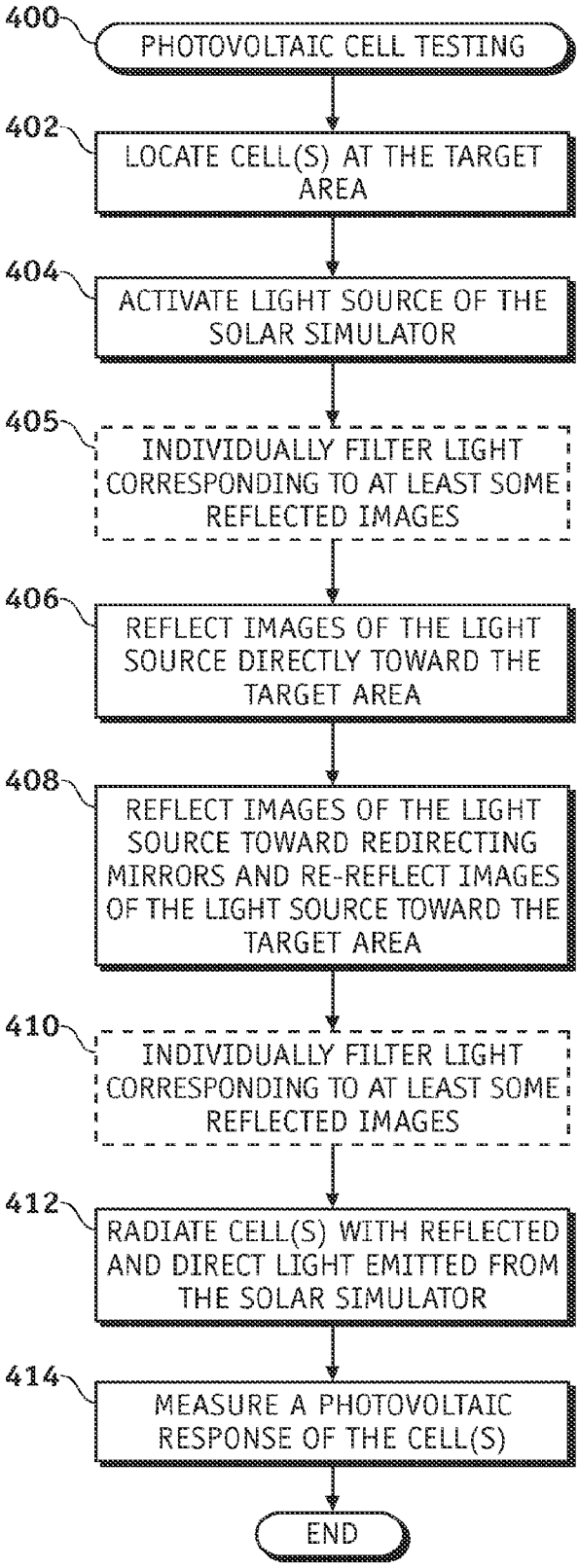
FIG. 11 is a flow chart that illustrates an embodiment of a photovoltaic cell testing process.

FIG. 11 is a flow chart that illustrates an embodiment of a photovoltaic cell testing process 400. Process 400 may utilize a solar simulator configured as described above. The various tasks performed in connection with process 400 may be performed by the solar simulator, components of the solar simulator, an operator, or other equipment that cooperates with the solar simulator. For illustrative purposes, the following description of process 400 may refer to elements mentioned above in connection with FIGS. 1-10. It should be appreciated that process 400 may include any number of additional or alternative tasks, the tasks shown in FIG. 11 need not be performed in the illustrated order, and process 400 may be incorporated into a more comprehensive procedure or process having additional functionality not described in detail herein.

Although not shown in FIG. 11, process 400 may involve one or more preliminary tasks associated with the setup of the solar simulator. For example, it may be necessary to first determine a desired spectral content of radiating light for the photovoltaic cell or cells under test. This determination may be influenced by the type of photovoltaic cells being tested, the intended deployment environment, the anticipated spectral characteristics of the sunlight to which the cells will be exposed, etc. Once the desired spectral content for the emitted light is determined, it may be possible (depending upon the particular embodiment of the solar simulator) to select a plurality of filters to be used with the solar simulator and/or to select a plurality of wavelength-sensitive mirrors for the solar simulator. In practice, the selection of the filters and the selection of the wavelength-sensitive mirrors will be based upon or otherwise influenced by the desired spectral content to be generated by the solar simulator. It may also be possible to determine or select the desired intensity of radiating light for the cells, using some or all of the criteria described above. Once the desired intensity has been determined, it may be possible (depending upon the particular embodiment of the solar simulator) to select an arrangement of mirrors inside the housing of the solar simulator. In practice, the selection of the mirror arrangement and configuration will be based upon or otherwise influenced by the desired light intensity.

If filters will be used with the solar simulator, then the filters will be installed in respective imaging paths between the mirrors and the cells. Since each filter is configured to alter the spectral characteristics of light passing through it, the combined effect will be to adjust the overall spectral content of the light reaching the target area. As described above, these filters are preferably installed inside the housing of the solar simulator. If wavelength-sensitive mirrors will be used with the solar simulator, then specific mirror assemblies having the desired reflective properties will be installed in the solar simulator. These preliminary steps are optional, they need not be performed for each test, and they need not be performed for all applications.

Eventually, the solar simulator is initialized and one or more photovoltaic cells are located at the target area (task 402), where the target area is aligned with the primary opening of the solar simulator. Assuming that the cells are coupled to appropriate test equipment, photovoltaic cell testing process 400 will activate the light source of the solar simulator (task 404). As mentioned above, a practical embodiment will pulse the light source to flash illuminate the light source. If the solar simulator includes light filters, then photovoltaic cell testing process 400 may individually filter light (optional task 405) that will correspond to at least some of the reflected and/or re-reflected images of the illuminated light source. In practice, task 405 may be accomplished using individual filters that filter light before it reaches the mirrors. Such filtering results in the tuning of the overall spectral content of the light reaching the target area.

A number of mirrors inside the solar simulator reflect images of the illuminated light source directly toward the target area (task 406) in the manner described above. In this embodiment, at least some of the concave mirrors, the flat mirrors, the flat exit mirrors, and the top and bottom cover mirrors directly reflect the light source such that reflected light corresponding to the illuminated light source passes through the primary opening of the solar simulator. In this regard, reflected images of the illuminated light source will be visible through the primary opening from the perspective of the target area. In other words, the cells will receive light directly from the light source, along with light reflected from mirrors.

In addition, at least some images of the illuminated light source will be reflected toward redirecting mirrors, which in turn re-reflect images of the illuminated light source toward the target area (task 408). The embodiment of the solar simulator described above utilizes flat mirrors to re-reflect the images of the light source. In practice, these re-reflected images of the illuminated light source are also visible through the primary opening from the perspective of the target area.

In lieu of (or in addition to) task 405, photovoltaic cell testing process 400 may filter light that has already been reflected and/or re-reflected (optional task 410). As mentioned previously, such filtering results in the tuning of the overall spectral content of the light reaching the target area. The reflected and direct light emitted from the solar simulator is used to radiate the photovoltaic cells located at the target area (task 412). This radiation causes the cells to react, and process 400 then measures a photovoltaic response of the cells (task 414). The testing procedure may thereafter be repeated as needed to test additional cells.

While at least one example embodiment has been presented in the foregoing detailed description, it should be appreciated that a vast number of variations exist. It should also be appreciated that the example embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method of testing a photovoltaic cell, the method comprising:

determining a desired spectral content of radiating light for the photovoltaic cell;

adjusting a solar simulator to provide the desired spectral content of radiating light for the photovoltaic cell locating the photovoltaic cell at a target area that is aligned with an opening of the solar simulator;

activating an illuminated light source located inside the housing of the solar simulator;

reflecting images of the illuminated light source with the plurality of concave mirrors located inside the housing, such that reflected light corresponding to the illuminated light source passes through the opening, wherein the plurality of concave mirrors further includes:

a first plurality of concave mirrors located approximately in a first direction from the light source, the first plurality of concave mirrors arranged into a first set of concave mirrors and a second set of concave mirrors, and wherein the first set of concave mirrors and the second set of concave mirrors are disposed symmetrically with respect to an axis defined by a line between the light source and a center of the target area;

a second plurality of concave mirrors located approximately in a second direction from the light source;

a third plurality of concave mirrors located approximately in a third direction from the light source, wherein the second plurality of concave mirrors and the third plurality of concave mirrors are disposed symmetrically with respect to the axis;

a fourth plurality of flat mirrors located approximately in the second direction;

a fifth plurality of flat mirrors located approximately in the third direction, wherein the fourth plurality of flat mirrors and the fifth plurality of flat mirrors are disposed symmetrically with respect to the axis;

a sixth flat mirror located approximately in a fourth direction from the light source and further located about at the opening; and a seventh flat mirror located approximately in a fifth direction from the light source and further located about at the opening, wherein the sixth flat mirror and the seventh flat mirror are disposed symmetrically with respect to the axis, and wherein the sixth flat mirror and the seventh flat mirror together form exit mirror assemblies;

radiating the photovoltaic cell with the reflected light emitted from the opening; and measuring a photovoltaic response of the photovoltaic cell.

2. The method according to claim 1, further comprising:

determining a desired intensity of radiating light for the photovoltaic cell; and selecting an arrangement of the plurality of concave mirrors inside the housing based upon the desired intensity, wherein the arrangement of the plurality of concave mirrors enables the solar simulator to produce the desired intensity of radiating light.

3. The method according to claim 1, wherein a concave mirror of the plurality of concave mirrors is coupled to a mounting plate, and further comprising installing a filter by coupling the filter to the mounting plate.

4. The method according to claim 3, wherein the filter comprises a removable filter.

5. The method of claim 1, wherein each of the plurality of concave mirrors is coupled to a corresponding mounting plate in a plurality of mounting plates, and further comprising installing a filter to a corresponding mounting plate in the plurality of mounting plates.

6. The method of claim 3, wherein the filter is positioned between the concave mirror and the illuminated light source.

7. A method of testing a photovoltaic cell, the method comprising:

determining a desired spectral content of radiating light for the photovoltaic cell;

adjusting a solar simulator comprising a plurality of concave mirrors to provide the desired spectral content of radiating light for the photovoltaic cell, adjusting comprising:

selecting a plurality of wavelength-sensitive concave mirrors based upon the desired spectral content; and installing the plurality of wavelength-sensitive concave mirrors for use as at least some of the plurality of concave mirrors;

locating the photovoltaic cell at a target area that is aligned with an opening of the solar simulator;

activating an illuminated light source located inside a housing of the solar simulator;

reflecting images of the illuminated light source with the plurality of concave mirrors located inside the housing, such that reflected light corresponding to the illuminated light source passes through the opening, wherein the plurality of concave mirrors further includes:

a first plurality of concave mirrors located approximately in a first direction from the light source, the first plurality of concave mirrors arranged into a first set of concave mirrors and a second set of concave mirrors, and wherein the first set of concave mirrors and the second set of concave mirrors are disposed symmetrically with respect to an axis defined by a line between the light source and a center of the target area;

a second plurality of concave mirrors located approximately in a second direction from the light source;

a third plurality of concave mirrors located approximately in a third direction from the light source, wherein the second plurality of concave mirrors and the third plurality of concave mirrors are disposed symmetrically with respect to the axis;

a fourth plurality of flat mirrors located approximately in the second direction;

a fifth plurality of flat mirrors located approximately in the third direction, wherein the fourth plurality of flat mirrors and the fifth plurality of flat mirrors are disposed symmetrically with respect to the axis;

a sixth flat mirror located approximately in a fourth direction from the light source and further located about at the opening; and a seventh flat mirror located approximately in a fifth direction from the light source and further located about at the opening, wherein the sixth flat mirror and the seventh flat mirror are disposed symmetrically with respect to the axis, and wherein the sixth flat mirror and the seventh flat mirror together form exit mirror assemblies;

radiating the photovoltaic cell with the reflected light emitted from the opening; and measuring a photovoltaic response of the photovoltaic cell.

8. A method of testing a photovoltaic cell, the method comprising:

determining a desired spectral content of radiating light for the photovoltaic cell;

adjusting a solar simulator comprising a plurality of concave mirrors to provide the desired spectral content of radiating light for the photovoltaic cell, adjusting comprising removing a concave mirror of the plurality of concave mirrors from the solar simulator;

locating the photovoltaic cell at a target area that is aligned with an opening of the solar simulator;

activating an illuminated light source located inside a housing of the solar simulator;

reflecting images of the illuminated light source with the plurality of concave mirrors located inside the housing, such that reflected light corresponding to the illuminated light source passes through the opening, wherein the plurality of concave mirrors further includes:

a first plurality of concave mirrors located approximately in a first direction from the light source, the first plurality of concave mirrors arranged into a first set of concave mirrors and a second set of concave mirrors, and wherein the first set of concave mirrors and the second set of concave mirrors are disposed symmetrically with respect to an axis defined by a line between the light source and a center of the target area;

a second plurality of concave mirrors located approximately in a second direction from the light source;

a third plurality of concave mirrors located approximately in a third direction from the light source, wherein the second plurality of concave mirrors and the third plurality of concave mirrors are disposed symmetrically with respect to the axis;

a fourth plurality of flat mirrors located approximately in the second direction;

a fifth plurality of flat mirrors located approximately in the third direction, wherein the fourth plurality of flat mirrors and the fifth plurality of flat mirrors are disposed symmetrically with respect to the axis;

a sixth flat mirror located approximately in a fourth direction from the light source and further located about at the opening; and a seventh flat mirror located approximately in a fifth direction from the light source and further located about at the opening, wherein the sixth flat mirror and the seventh flat mirror are disposed symmetrically with respect to the axis, and wherein the sixth flat mirror and the seventh flat mirror together form exit mirror assemblies;

radiating the photovoltaic cell with the reflected light emitted from the opening; and measuring a photovoltaic response of the photovoltaic cell.

9. The method according to claim 8, wherein the concave mirror is coupled to a mounting plate, wherein the mounting plate is coupled to a number of mounting brackets using a number of spring-loaded fasteners, and wherein removing the first concave mirror comprises removing the mounting plate from the number of mounting brackets using the number of spring-loaded fasteners.

* * * * *